US006827582B2

(12) United States Patent
Morris et al.

(10) Patent No.: US 6,827,582 B2
(45) Date of Patent: Dec. 7, 2004

(54) CONNECTOR BLOCK HAVING AN ISOLATION CIRCUIT

(75) Inventors: Richard D. Morris, Fort Worth, TX (US); Janneth Badillo, Tamaulipas (MX); William A. Holder, Gilmer, TX (US)

(73) Assignee: Corning Cable Systems LLC, Hickory, NC (US)

( * ) Notice: Subject to any disclaimer, the term of this patent is extended or adjusted under 35 U.S.C. 154(b) by 18 days.

(21) Appl. No.: 10/256,576

(22) Filed: Sep. 27, 2002

(65) Prior Publication Data

US 2004/0063338 A1 Apr. 1, 2004

(51) Int. Cl.[7] ..... H01R 29/00

(52) U.S. Cl. ..... 439/49; 439/718; 439/716; 439/620; 379/326

(58) Field of Search ..... 439/716, 709, 439/49, 719, 718, 620, 43; 174/60; 379/326, 327, 325; 361/823, 826

(56) References Cited

U.S. PATENT DOCUMENTS

| | | | | |
|---|---|---|---|---|
| 4,287,515 A | | 9/1981 | Raber et al. | 340/584 |
| 4,387,456 A | | 6/1983 | Creteau | 370/13 |
| 4,610,493 A | * | 9/1986 | Masek | 439/98 |
| 4,830,621 A | * | 5/1989 | Maue et al. | 439/52 |
| 4,854,884 A | * | 8/1989 | Unger | 439/92 |
| 4,862,314 A | * | 8/1989 | Corvino et al. | 361/119 |
| 5,323,145 A | | 6/1994 | Simmering | 340/825.16 |
| 5,755,742 A | * | 5/1998 | Schuelke et al. | 607/27 |
| 6,404,347 B1 | | 6/2002 | Kiko | 340/653 |

OTHER PUBLICATIONS

Corning, "Model 139 VERSABLOCK®", Aug. 2000.

* cited by examiner

*Primary Examiner*—Gary Paumen
*Assistant Examiner*—Edwin A. Leon
(74) *Attorney, Agent, or Firm*—Michael E. Carroll, Jr.

(57) ABSTRACT

A connector block having an alarm-isolation circuit includes a first alarm input terminal, a second alarm input terminal, a first alarm output terminal, a second alarm output terminal, and at least one diode. The first and second alarm input terminals are operable for electrical connection with a two-wire alarm input. The first and second alarm output terminals are electrically connected respectively to the first and second alarm input terminals. The at least one diode is electrically connected between the first alarm input terminal and a first alarm output terminal, thereby forming a portion of the alarm-isolation circuit. The one alarm-isolation circuit is capable of forwarding an electrical signal to a remote location. In other embodiments, a diode is used between each alarm input terminal and alarm output terminal, thereby inhibiting feedback among the alarm output terminals and the associated alarm input terminal.

21 Claims, 7 Drawing Sheets

CONNECTOR BLOCK HAVING AN ISOLATION CIRCUIT

FIELD OF THE INVENTION

The present invention relates generally to a connector block, and more particularly, to a connector block having an isolation circuit for use as, for example, an alarm-isolation connector block at the central office of a telephone service provider.

BACKGROUND OF THE INVENTION

Telephone service providers use distribution cables to route land-based telephone lines from the subscribers' premises to a central location for connection with the telephone network. These central locations are called central offices and include a variety of telephone network equipment for functions such as electrical surge protection, back-up power generation, and generation of telephone records. Due to the number of central offices required in a telephone network, it is cost-prohibitive to man all of the central offices with employees. However, the telephone service provider generally desires to monitor the unmanned central offices.

Consequently, central offices are typically connected to a Network Operations Center (NOC) via a trunk cable. Employees of the telephone service provider at the NOC can monitor the building operations of several central offices from one location. For instance, central offices can include alarms for monitoring door alarms, low-fuel in the generator, and/or generator failures. These alarms are typically tied into a conventional connector block at the central office that is electrically connected to the NOC for monitoring by personnel. However, electrical feedback in conventional connector blocks can cause overloading of the circuit used to report abnormal conditions to the NOC.

SUMMARY OF THE INVENTION

The present invention is directed to a connector block having at least one alarm-isolation circuit including first and second alarm input terminals that are operable for electrical connection with respective wires of an alarm input. First and second alarm output terminals are, respectively, electrically connected to the first and second alarm input terminals. Additionally, at least one diode is electrically connected between the first alarm input terminal and the first alarm output terminal. Thus, forming a portion of the at least one alarm-isolation circuit capable of forwarding an electrical signal to a remote location when the alarm is activated.

The present invention is also directed to a connector block having at least one alarm-isolation circuit including first and second alarm input terminals that are operable for electrical connection with respective alarm inputs. A first and a second plurality of alarm output terminals each being, respectively, electrically connected to the first and second alarm input terminals. Additionally, a first and second plurality of diodes are, respectively, electrically connected between the first alarm input terminal and one of the first plurality of alarm output terminals and electrically connected between the second alarm input terminal and the one of the second plurality of alarm output terminals.

The present invention is further directed to a connector block having at least one alarm-isolation circuit including two alarm input terminals that are operable for electrical connection with a two wire alarm input. A plurality of alarm output terminals being electrically connected to one of the two alarm input terminals. A plurality of diodes are electrically connected to one of the two alarm input terminals, thereby inhibiting feedback between the plurality of alarm output terminals.

The present invention is also directed to an alarm-isolation circuit including a first and a second alarm input terminal that are operable for electrical connection with respective alarm inputs. First and second alarm output terminals are, respectively, electrically connected to the first and second alarm input terminals. Additionally, at least one diode is electrically connected between the first alarm input terminal and the first alarm output terminal. Thus, forming a portion of the alarm-isolation circuit capable of forwarding an electrical signal to a remote location when the alarm is activated.

BRIEF DESCRIPTION OF THE FIGS

FIG. 3 is a rear perspective view of the connector block of FIG. 1 as assembled.

DETAILED DESCRIPTION OF THE INVENTION

Illustrated in FIGS. 1–5 is a connector block 10 having an alarm-isolation circuit according to the present invention. Connector block 10 is intended for use at a telephone central office (CO). Specifically, connector block 10 is intended to provide a central tie-down wiring point for the various alarms in the CO. Alarms at the CO can, for example, include door alarms, emergency generator activation alarms, fire alarms, smoke alarms, battery failure alarms, generator low-fuel alarm, splice chamber access alarm, or any other suitable alarm. An alarm at the CO can be electrically connected to connector block 10 as an alarm input that is capable of forwarding an electrical signal through a portion of an alarm-isolation circuit to one or more alarm outputs. Each alarm output circuit has at least one diode in the alarm-isolation circuit, thereby isolating the individual alarm outputs from one another. In other words, the alarm-isolation circuit inhibits feedback from one alarm output circuit from interfering with another alarm output circuit. In one application, connector block 10 can be located in a unmanned CO with the alarm outputs of connector block 10 being wired to a manned Network Operations Center (NOC). By wiring the alarm outputs to the NOC, employees of the telephone service provider are notified of the alarm being activated and can respond to the alarm. This advantageously provides monitoring of alarms at an unmanned CO. Additionally, alarm outputs of connector block 10 can also be wired to local police, fire departments, or other suitable locations via trunk cables electrically connected to the alarm outputs. However, the concepts of the present invention are applicable to similar environments or devices that desire circuit isolation.

Figure 1:
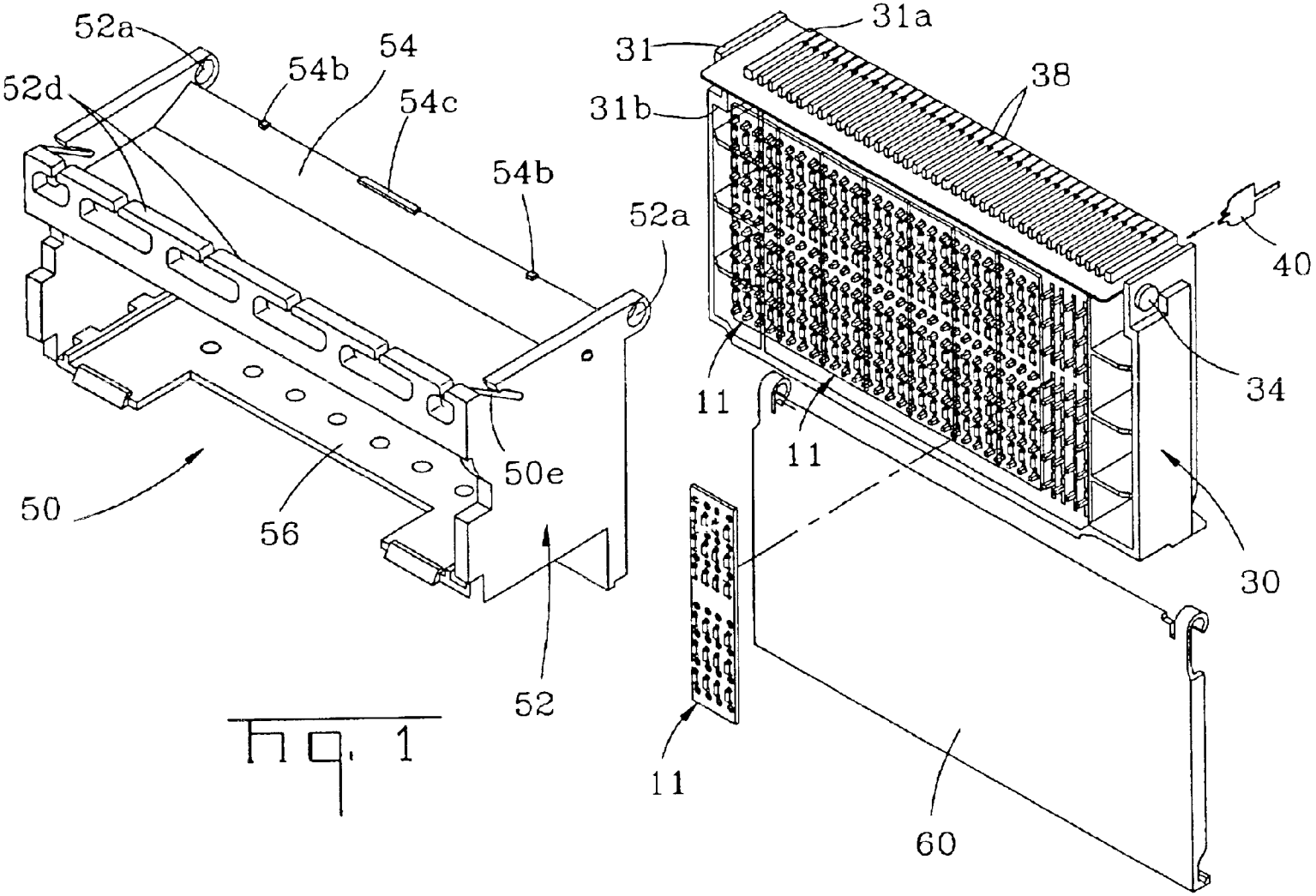
FIG. 1 is a partially exploded rear perspective view of a connector block according to one embodiment of the present invention.
Figure 2:
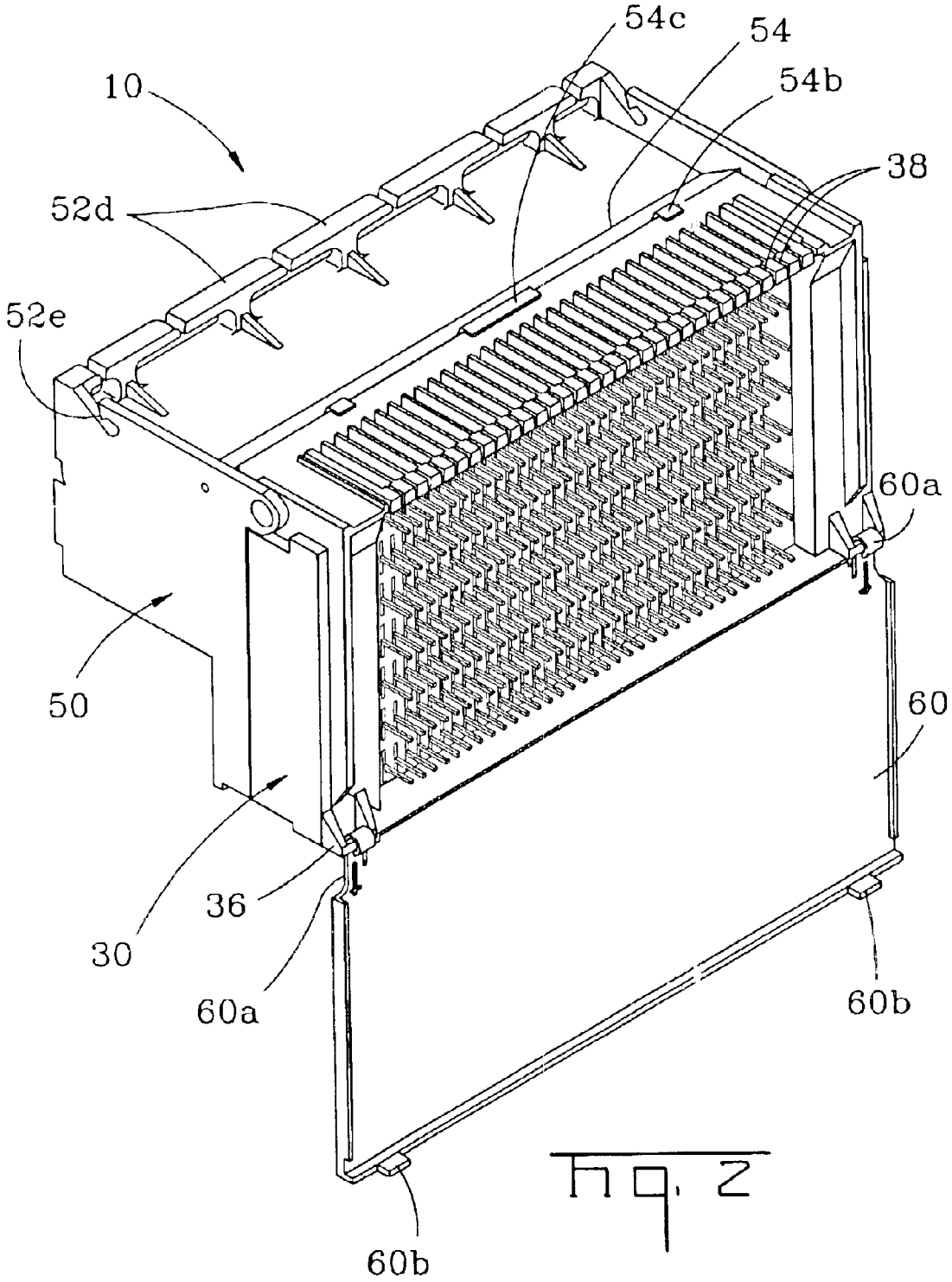
FIG. 2 is a front perspective view of the connector block of FIG. 1 as assembled having the front panel open.

FIG. 1 depicts a partially exploded perspective view of connector block 10 that includes a plurality of circuit board assemblies 11 that are a portion of a pin-block assembly 30, a housing assembly 50, and a front panel 60. However, the concepts of the present invention may be used with other configurations of connector blocks having additional components, such as a mounting bracket, or with fewer components, such as only a single circuit board assembly. Likewise, the concepts of the present invention can be used on a circuit board without a connector block, or on a connector block without a circuit board.

Figure 6:
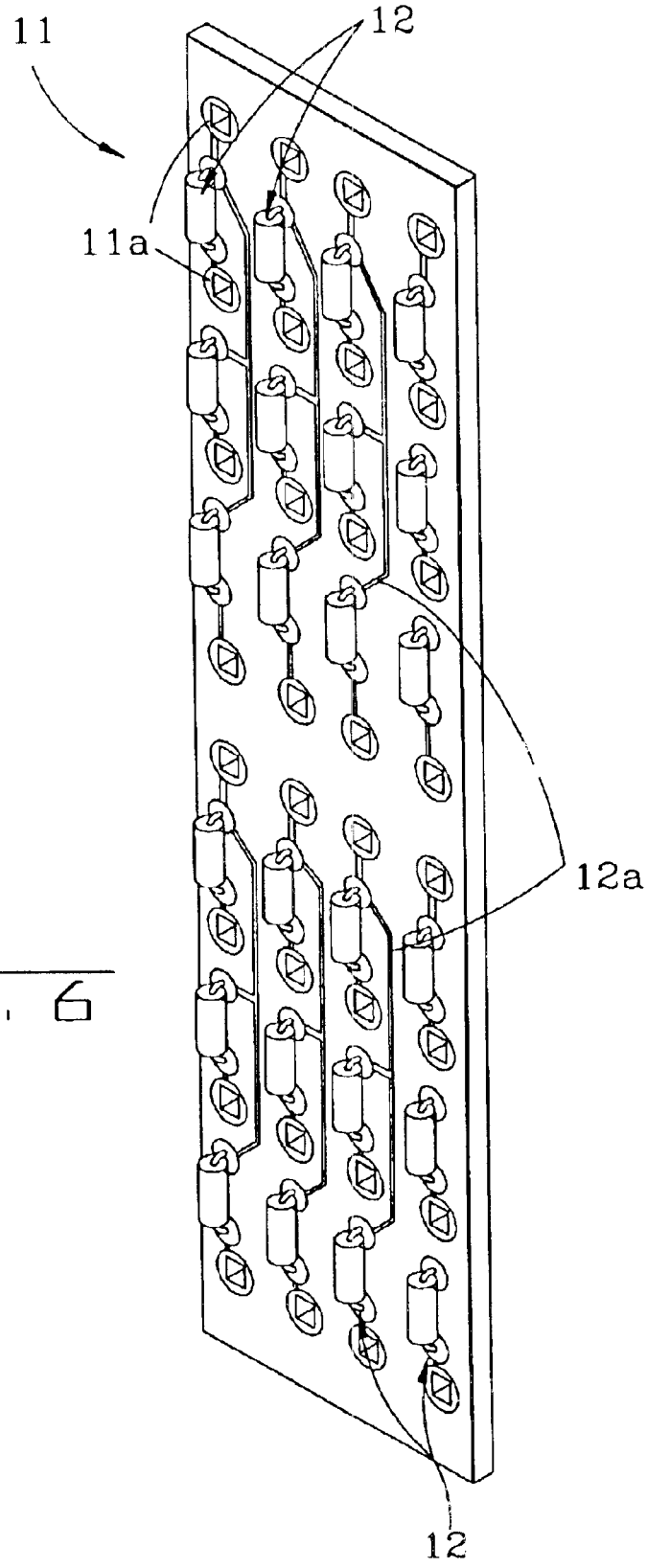
FIG. 6 is a perspective view of the circuit board of the connector block of FIG. 1.
Figure 7:
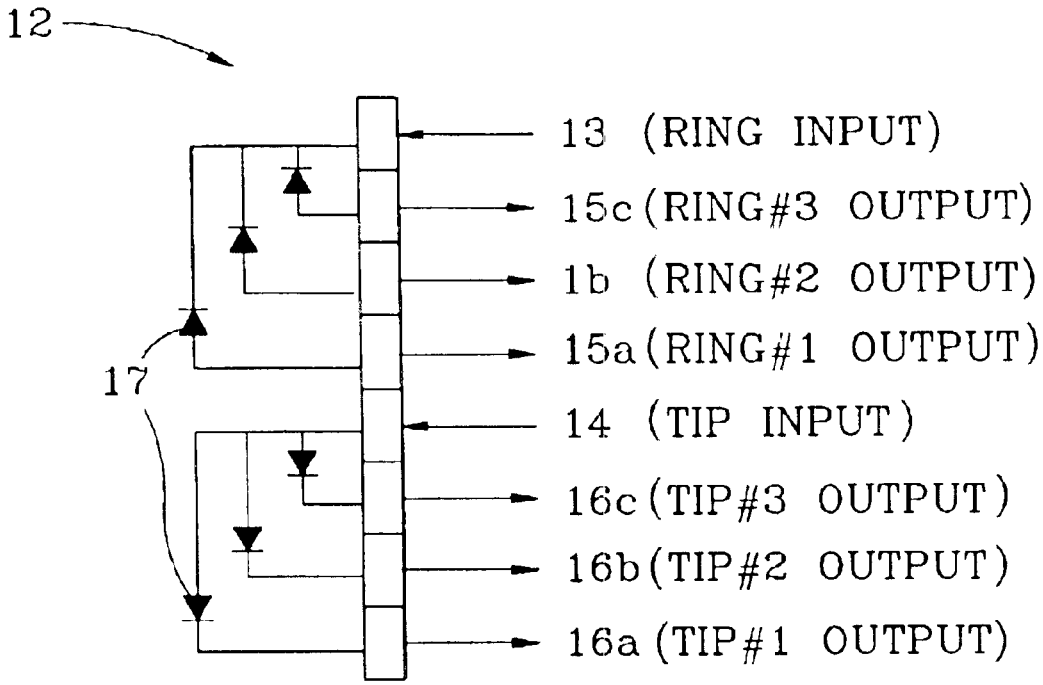

Specifically, the embodiment of FIGS. 1–5 includes eight circuit board assemblies 11 (FIG. 6). In particular, each circuit board assembly 11 has four alarm-isolation circuits 12. Thus, connector block 10 has thirty-two alarm-isolation circuits; however, connector blocks and/or circuit boards can include any suitable number of alarm-isolation circuits. For purposes of packaging and circuit densities, electrical traces 12*a* (FIG. 6) are disposed on both sides of circuit board assembly 11. This advantageously allows for uniform and efficient spacing of electrical connectors on pin-block assembly 30. Specifically, electrical traces 12*a* for three of the alarm-isolation circuits 12 are disposed on one side of circuit board assembly 11, while the fourth electrical trace 12*a* (not shown) is disposed on the opposite side of circuit board assembly 11.

Figure 7:
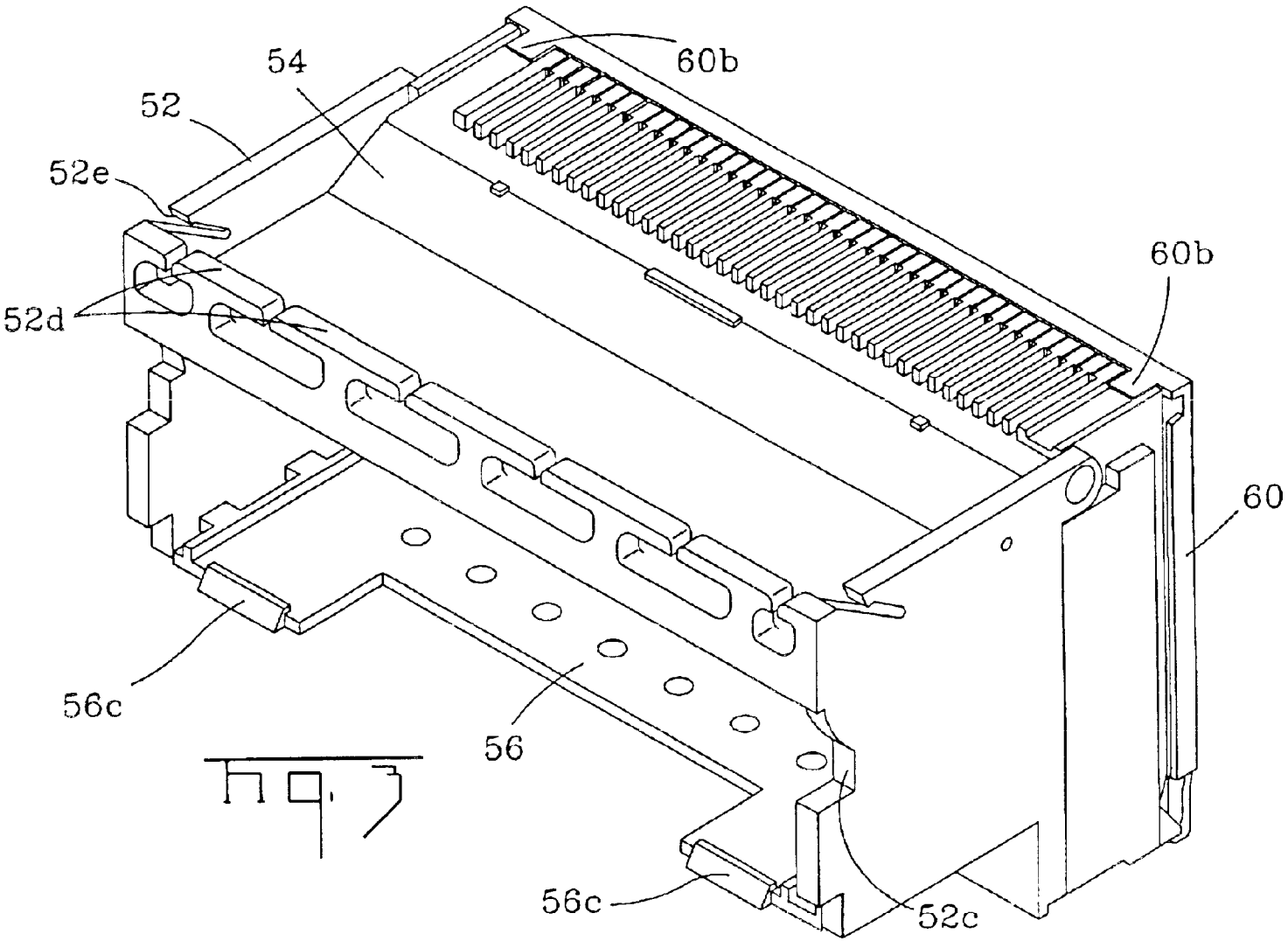
FIG. 7 is a schematic representation of one of the alarm-isolation circuits of the circuit board of FIG. 6.

As shown schematically in FIG. 7, alarm-isolation circuit 12 includes a first alarm input terminal 13, a second alarm input terminal 14, at least a first alarm output terminal 15*a*, at least a second alarm output terminal 16*a*, and at least one diode 17. However, alarm input terminal 14 could be the first alarm input terminal. FIG. 7 depicts alternative labels for respective terminals in parenthesis. In the telecommunications industry, the wires of a two-wire circuit are commonly referred to as ring and tip connections. In other words, alarm input terminal 13 is the ring input terminal and alarm input terminal 14 is the tip input terminal and are operable for electrical connection with a two-wire alarm input. Examples of alarm inputs are door alarms, fire alarms, smoke alarms, or any other suitable two-wire alarm input signal. First and second alarm output terminals 15*a*,16*a* (respectively ring#1 output and tip#1 output) are electrically connected to respective alarm input terminals 13,14 and are operable for electrical connection with a first two-wire alarm output. Additionally, embodiments of the present invention can include more than one set of alarm output terminals. For instance, alarm output terminals 15*b*,16*b* and 15*c*,16*c* are also electrically connected to respective alarm input terminals 13,14 and are operable for electrical connection with second and third two-wire alarm outputs. Each alarm-isolation circuit 12 also includes at least one diode 17. Diode 17 is electrically connected between an alarm input terminal and an alarm output terminal and can be part of circuit board assembly 11. Generally speaking, diodes 17 can be selected based on the requirements for the particular application. In this case, diode 17 preferably has a rating of about five-hundred milliwatts and about one-hundred volts; however, diodes with other suitable ratings can be used.

In preferred embodiments, circuit board assembly 11 has a plurality of diodes 17. For example, one diode 17 is electrically connected between each alarm output terminal and the respective alarm input terminal (ring or tip) as depicted in FIG. 7, thereby inhibiting feedback between the alarm output terminals and the associated alarm input terminal. However, other suitable configurations are possible. Additionally, diodes 17 have a specific orientation in alarm-isolation circuit 12, thereby allowing a voltage drop and a current to pass in one direction to the remote locations such as the NOC. Specifically, diodes 17 are electrically connected permitting current to flow into alarm input terminal 14, through respective diode 17 to respective alarm output terminals 16*a*, 16*b*, and/or 16*c*, thereby forwarding an electrical signal to respective remote locations. The electrical signal returns from the respective remote locations to respective alarm output terminals 15*a*, 15*b*, and 15*c*, through respective diode 17 to alarm input terminal 13 and out of connector block 10. Thus, each respective two-wire alarm output to the remote location is electrically isolated from other two-wire alarm outputs connected to the same two-wire alarm input, thereby inhibiting undesired electrical feedback to the remote locations.

As depicted in FIG. 1, pin-block assembly 30 includes a pin block 31, a plurality of electrical connectors 40, and a plurality of circuit boards 11. The plurality of electrical connectors 40 are inserted into a front side 31*a* of pin-block 31 and attached thereto. The plurality of circuit boards 11 are electrically attached to electrical connectors 40 at the rear side 31*b* of-pin block 31.

Figure 8:
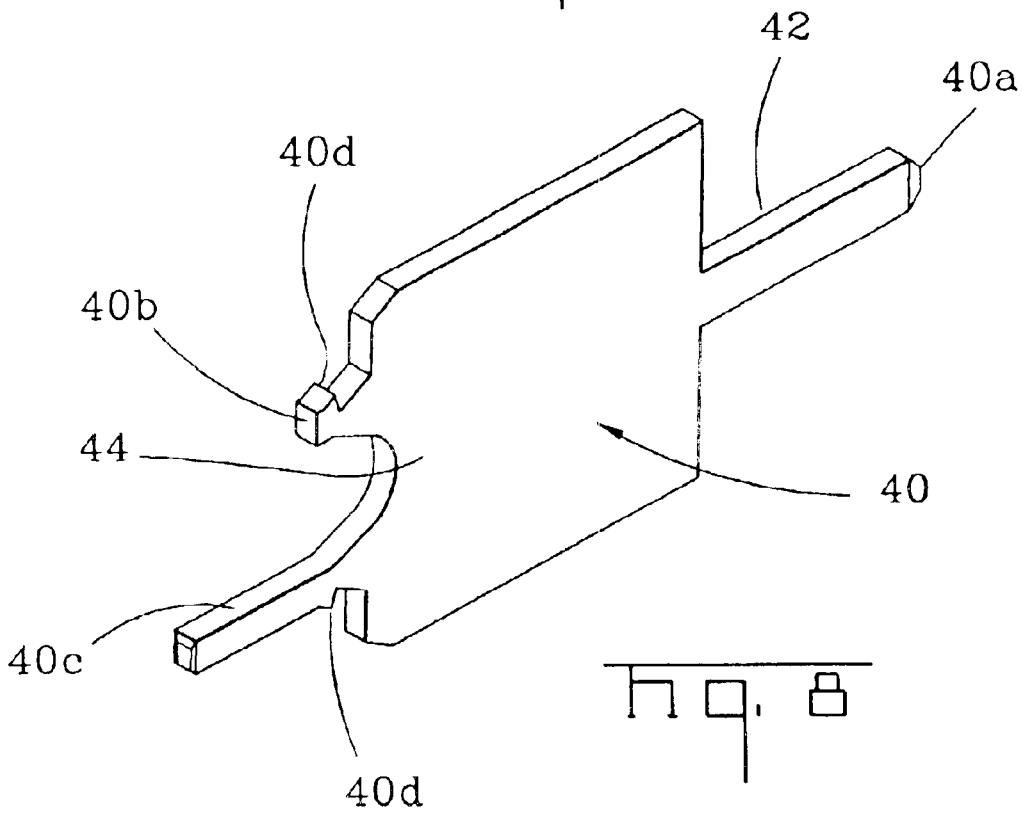
FIG. 8 is a perspective view of the electrical connector of the connector block of FIG. 1.

As depicted in FIG. 8, electrical connector 40 has a first end 42 and a second end 44. First end 42 has a wire-wrapping pin 40*a* that is intended for electrical connection with either a wire of an alarm input wire or an alarm output wire. On the other hand, second end 44 includes a leg 40*b* and a pin 40*c*. Second end 44 is intended for soldering after insertion of electrical connector 40 into a predetermined rectangular aperture (not shown) of pin-block 31. However, any other suitable electrical connection can be used such as IDCs or screw terminals. As second end 44 of electrical connector 40 is inserted into the rectangular aperture to a predetermined depth fingers 40*d* latch behind protrusions (not shown) within the rectangular aperture, thereby attaching electrical connector 40 to pin-block 31. After insertion, pin 40*c* of electrical connector 40 extends past the rear side 31*b* of pin-block 31. After attaching all of the electrical connectors 40, a plurality of predetermined terminals 11*a* of a predetermined circuit board 11 are inserted over and pass onto a plurality of predetermined pins 40*c* during the assembly of circuit board 11 with pin-block 31. In this embodiment, a reliable electrical connection is made between the plurality of predetermined pins 40*c* and the plurality of predetermined terminals 11*a* by soldering pin 40*c* to circuit board 11. However, any other suitable electrical connections as known in the art can be used.

Additionally, front side 31*a* of pin-block 31 may include a checkerboard like grid (not shown), thereby aiding the craftsman in easily locating predetermined pins 40*a* to accurately make electrical connections to the array of pins 40*a*. Pin-block 31 also includes housing assembly pin hinges 34 (FIG. 1), front panel hinges 36 (FIG. 2), and fanning strips 38 to organize and route wires to wire-wrapping pins 40*a* of electrical connectors 40.

Housing assembly 50 includes a housing 52, a dust cover 54, and a plate 56. Dust cover 54 is rotatably mounted to housing 52 via pins 54*a* (FIG. 5) thereon. Dust cover 54 also includes at least one retaining element 54*b* and a stop 54*c*. Retaining elements 54*b* engage a portion of pin-block 31 when pin-block assembly 30 is in a stored position and stop 54*c* protects retaining elements 54*b* from breakage by inhibiting over-rotation of dust cover 54. Plate 56 has guides (not shown) and retaining elements (not shown), thereby positioning and securing plate 56 to housing 52. Plate 56 also includes latches 56*c* for securing connector block 10 to a mounting bracket.

Figure 4:
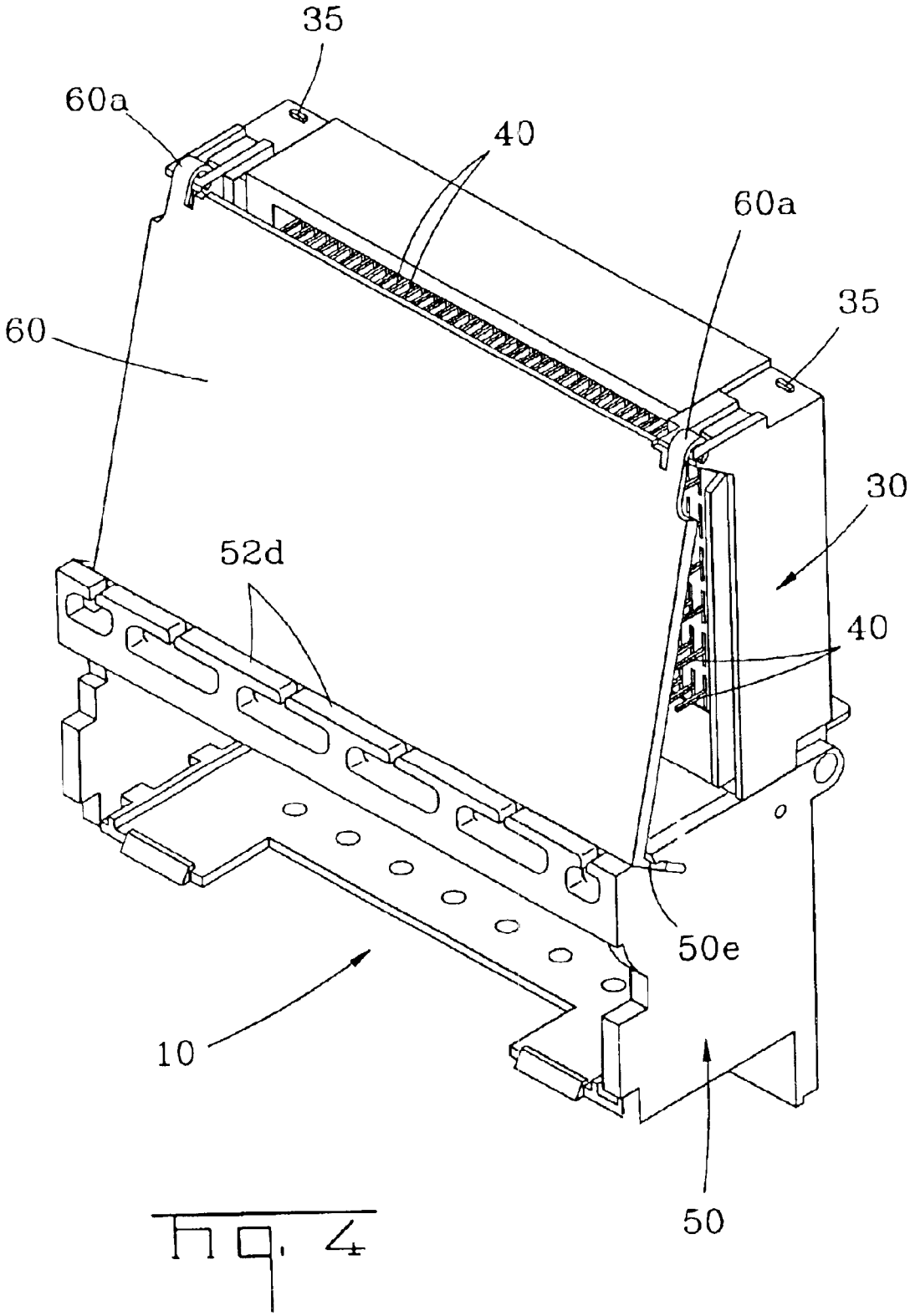
FIG. 4 is a rear perspective view of the connector block of FIG. 1 as assembled shown with the housing assembly rotated to an open position.
Figure 5:
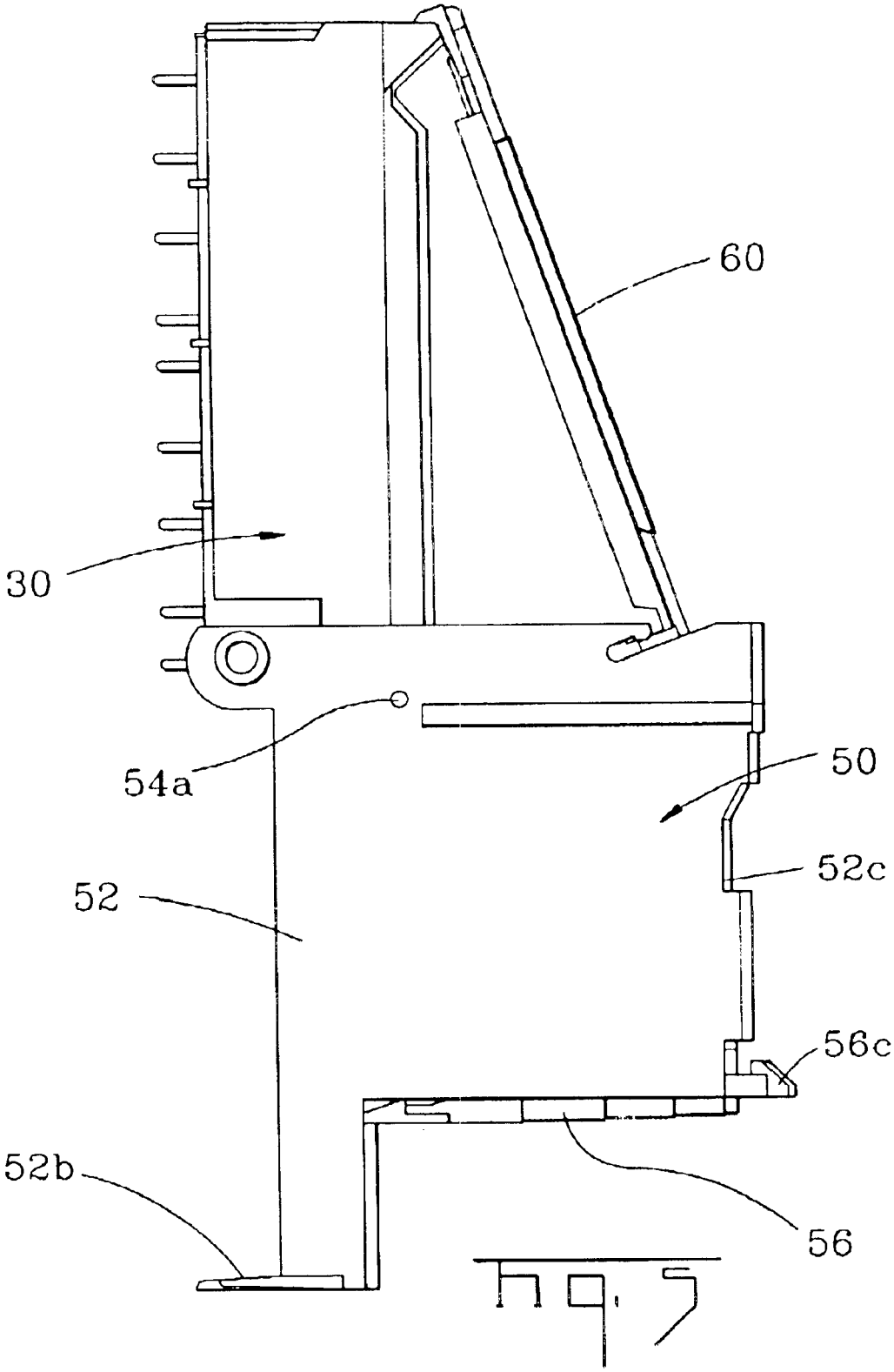
FIG. 5 is a side elevation view of the connector block of FIG. 1 showing the pin-block assembly rotated to an open position, thereby allowing access to the circuit boards.

Housing assembly 50 is hingedly connected to pin-block assembly 30 via apertures 52*a* disposed on opposing top portions of housing 52. On the bottom side of housing 52 are a pair of resilient locking tabs 52*b* (FIG. 5) that engage protrusions 35 (FIG. 4) on pin-block 31. Tabs 52*b* secure pin-block assembly 30 in a stored position and can be unlatched, thereby allowing the rotation of pin-block assembly 30 upward to access the rear side 31*b* of pin-block 31 (FIG. 4). This advantageously allows access to inspect and/or service diodes 17 without removing connector block 10 from its mounting arrangement. Connector block 10 can be secured to a mounting bracket (not shown) that is attached to a frame. For example, notches 52*c* can engage the mounting bracket and latches 56*c* on plate 56 snap-fit onto the mounting bracket, thereby securing connector block 10 to the mounting bracket. Additionally, housing 52 includes a plurality of wire guides 52*d* for separating and organizing wires before entering fanning strips 38 of pin-block 31 and two latching fingers 52*e* for locking pin-block assembly 30 in an inspection/service position.

Connector block 10 also includes a front panel 60 that is hingedly connected to pin-block assembly 30. Specifically, front panel 60 has arms 60*a* that engage hinges 36 of pin-block 31, thereby allowing the rotation of front panel 60 from a closed position to an open position. Front panel 60 is secured into the closed position by latches 60*b* that engage a portion of pin-block 31. Thus, the wiring of the electrical connections between wire-wrapping pins 40*a* and the wires of the inputs/outputs are accessible by opening front panel 60 and can be concealed by closing the same. Additionally, a circuit schematic decal can be applied to the inside of front panel 60 so that the craftsman can ascertain how to wire connector block 10 and can assign a description to each alarm-isolation circuit.

Connector block 10 of the present invention also advantageously allows the inspection and/or service of diodes 17 while connector block 10 is mounted. In order to access the rear of pin-block assembly 30, tabs 52*b* are unlatched from pin-block 31 and front panel 60 is opened. Next, dust cover 54 is unlatched and rotated until it contacts housing 52, thereby allowing pin-block assembly 30 to rotate about 180 degrees forward (FIG. 4). The end portions of front panel 60 can be snap-fitted into latching fingers 52*e* disposed on housing 52 so that pin-block assembly is securely held in the position shown in FIG. 5, thereby allowing inspection/service by the craftsman.

Many modifications and other embodiments of the present invention, within the scope of the appended claims, will become apparent to a skilled artisan. For example, any suitable number of alarm-isolation circuits can be included on a circuit board and/or connector block. Additionally, alarm-isolation circuits can have any suitable number of alarm output terminals. In another embodiment, the connector block can eliminate the circuit boards by having the diodes electrically connected to the pins. Therefore, it is to be understood that the invention is not to be limited to the specific embodiments disclosed and that modifications and other embodiments may be made within the scope of the appended claims. Although specific terms are employed herein, they are used in a generic and descriptive sense only and not for purposes of limitation. The invention has been described with reference to a connector block in a central office application but the inventive concepts of the present invention are applicable to other environments or devices.

That which is claimed:

1. A connector block having at least one alarm-isolation circuit comprising:

a first alarm input terminal, the first alarm input terminal being operable for electrical connection with a first wire of an alarm input;

a second alarm input terminal, the second alarm input terminal being operable for electrical connection with a second wire of the alarm input;

a first alarm output terminal, the first alarm output terminal being electrically connected to the first alarm input terminal;

a second alarm output terminal, the second alarm output terminal being electrically connected to the second alarm input terminal; and at least one diode disposed on a circuit board and electrically connected between the first alarm input terminal and the first alarm output terminal, thereby forming a portion of the at least one alarm-isolation circuit capable of forwarding an electrical signal to a remote location when an alarm is activated.

2. The connector block according to claim 1, the circuit board having a plurality of diodes.

3. The connector block according to claim 1, the circuit board having a plurality of alarm-isolation circuit.

4. The connector block according to claim 1, further comprising a plurality of alarm-isolation circuits.

5. The connector block according to claim 1, further comprising eight circuit boards, each circuit board having four alarm-isolation circuits thereon.

6. The connector block according to claim 1, the connector block having a plurality of alarm-isolation circuits, the plurality of alarm-isolation circuits being disposed on a plurality of circuit boards.

7. The connector block according to claim 1, further comprising a plurality of first alarm output terminals, the plurality of first alarm output terminals being electrically connected to the first alarm input terminal, wherein each of the plurality of first alarm output terminals forms a portion of a plurality of alarm-isolation circuits capable of forwarding an electrical signal to remote locations when the alarm is activated.

8. The connector block according to claim 7, further comprising a plurality of diodes, each diode being electrically connected between one of the first alarm output terminals and the first alarm input terminal, wherein tho plurality of diodes inhibit feedback between the first alarm output terminals and the first alarm input terminal.

9. The connector block according to claim 1, further comprising a plurality of second alarm output terminals, the plurality of second alarm output terminals being electrically connected to the second alarm input terminal, wherein each of the plurality of second alarm output terminals forms a portion of a plurality of alarm-isolation circuits capable of forwarding an electrical signal to remote locations when the alarm is activated.

10. The connector block according to claim 9, further comprising a plurality of diodes, each diode being electrically connected between one of the second alarm output terminals and the second alarm input terminal, wherein the plurality of diodes inhibit feedback between the alarm output terminals and the second alarm input terminal.

11. A connector block having at least one alarm-isolation circuit comprising:

a first alarm input terminal, the first alarm input terminal being operable for electrical connection with a first wire of an alarm input;

a second alarm input terminal, the second alarm input terminal being operable for electrical connection with a second wire of the alarm input;

a first alarm output terminal, the first alarm output terminal being electrically connected to the first alarm output terminal;

a second alarm output terminal, the second alarm output terminal being electrically connected to the second alarm input terminal; and at least one diode electrically connected between the first alarm input terminal and the first alarm output terminal, thereby forming a portion of the at least one alarm-isolation circuit capable of forwarding an electrical signal to a remote location when an alarm is activated;

wherein at least one of the output or input terminals is the wire-wrap connector.

12. The connector block according to claim 11, the wire-wrap connector being soldered to a circuit board.

13. A connector block having at least one alarm-isolation circuit comprising:

a first alarm input terminal, the first alarm input terminal being operable for electrical connection with an alarm input;

a second alarm input terminal the second alarm input terminal being operable for electrical connection with an alarm input;

a first plurality of alarm output terminals, each of the first plurality of alarm output terminals being electrically connected to the first alarm input terminal;

a second plurality of alarm output terminals, each of the second plurality of alarm output terminals being electrically connected to the second alarm input terminal;

a first plurality of diodes, the first plurality of diodes being electrically connected between the first alarm input terminal and one of the first plurality of alarm output terminals; and a second plurality of diodes, the second plurality of diodes being electrically connected between the second alarm input terminal and one of the second plurality of alarm output terminals;

wherein at least one of the first plurality of diodes is disposed on a circuit board.

14. The connector block according to claim 13, the circuit board having a plurality of alarm-isolation circuits.

15. The connector block according to claim 13, further comprising a plurality of alarm-isolation circuits.

16. The connector block according to claim 13, further comprising eight circuit boards, each circuit board having four alarm-isolation circuits thereon.

17. The connector block according to claim 13, the connector block having a plurality of alarm-isolation circuits, the plurality of alarm-isolation circuits being disposed on a plurality of circuit boards.

18. A connector block having at least one alarm-isolation circuit comprising:

a first alarm input terminal, the first alarm input terminal being operable for electrical connection with an alarm input;

a second alarm input terminal, the second alarm input terminal being operable for electrical connection with an alarm input;

a first plurality of alarm output terminals, each of the first plurality of alarm output terminals being electrically connected to the first alarm input terminal;

a second plurality of alarm output terminals, each of the second plurality of alarm output terminal being electrically connected to the second alarm input terminal;

a first plurality of diodes, the first plurality of diodes being electrically connected between the first alarm input terminal and one of the first plurality of alarm output terminals; and a second plurality of diodes, the second plurality of diodes being electrically connected between the second alarm input terminal and one of the second plurality of alarm output terminals;

wherein at least one of the terminals is a wire-wrap connector.

19. The connector block according to claim 18, the wire-wrap connector being soldered to a circuit board.

20. A connector block having at least one alarm-isolation circuit comprising:

two alarm input terminals, the two alarm input terminals being operable for electrical connection with a two-wire alarm input;

a plurality of alarm output terminals, the plurality of alarm output terminals being electrically connected to one of the two alarm input terminals;

a plurality of diodes, the plurality of diodes being electrically connected to one of the two alarm input terminals, thereby inhibiting feedback between the plurality of alarm output terminals;

wherein at least one of the first plurality of diodes is disposed on a circuit board.

21. An alarm-isolation circuit comprising:

a first alarm input terminal, the first alarm input terminal being operable for electrical connection with an alarm input;

a second alarm input terminal, the second alarm input terminal being operable for electrical connection with an alarm input;

a first alarm output terminal, the first alarm output terminal being electrically connected to the first alarm input terminal;

a second alarm output terminal, the second alarm output terminal being electrically connected to the second alarm input terminal;

at least one diode disposed on a circuit board and electrically connected between the first alarm input terminal and the first alarm output terminal, thereby forming a portion of the alarm-isolation circuit capable of forwarding an electrical signal to a remote location when an alarm is activated.

* * * * *

UNITED STATES PATENT AND TRADEMARK OFFICE

CERTIFICATE OF CORRECTION

PATENT NO. : 6,827,582 B2 
DATED : December 7, 2004
INVENTOR(S) : Richard D. Morris, Jenneth Badillo and William A. Holder It is certified that error appears in the above-identified patent and that said Letters Patent is hereby corrected as shown below:

Column 6,
Line 46, delete "the" and replace with -- the --.

Signed and Sealed this

Eighth Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,827,582 B2 
DATED : December 7, 2004
INVENTOR(S) : Richard D. Morris, Jenneth Badillo and William A. Holder It is certified that error appears in the above-identified patent and that said Letters Patent is hereby corrected as shown below:

Column 6,
Line 46, delete "tho" and replace with -- the --.

This certificate supersedes Certificate of Correction Issued March 8, 2005.

Signed and Sealed this

Third Day of January, 2006

JON W. DUDAS
*Director of the United States Patent and Trademark Office*